US006095875A

United States Patent [19]

Allison

[11] Patent Number: 6,095,875

[45] Date of Patent: Aug. 1, 2000

[54] HYDRO-PLANING FOIL

[76] Inventor: Darris E. Allison, 106 Main St., Louisville, Tenn. 37777

[21] Appl. No.: 09/296,010

[22] Filed: Apr. 21, 1999

[51] Int. Cl.[7] ..... B63H 1/18

[52] U.S. Cl. ..... 440/66; 114/271

[58] Field of Search ..... 440/66, 67, 68, 440/69, 71, 900; 114/162, 271, 274, 281

[56] References Cited

U.S. PATENT DOCUMENTS

| | | | |
|---|---|---|---|
| 4,445,452 | 5/1984 | Loch | 440/66 |
| 4,738,644 | 4/1988 | Happel | 440/66 |
| 5,178,089 | 1/1993 | Hodel | 114/274 |
| 5,645,009 | 7/1997 | Lexau | 114/274 |

OTHER PUBLICATIONS

Bass Pro Shops Outdoor World 1993 Catalog, p. 321.

*Primary Examiner*—Stephen Avila
*Attorney, Agent, or Firm*—Luedeka, Neely & Graham, PC

[57] ABSTRACT

A detachable hydro-planing foil for a marine outboard propeller drive comprises a plate having leading edges that are substantially backswept symmetrically from a plate centerline and trailing edges that are arced in a forward concavity substantially symmetrically from the centerline. Laterally of the centerline, the plate terminates with plate tips that are down turned with a negative dihedral of between about 25° and about 45°. The forward concavity of the trailing edges sweeps the trailing edge forward of the forward propeller rotational plane.

17 Claims, 4 Drawing Sheets

HYDRO-PLANING FOIL

BACKGROUND OF THE INVENTION

The present invention relates to high performance sport boats with a length of about twenty-five feet or less. More particularly, the invention relates to marine hydroplaning foils for high performance sport boats having a propeller drive.

High performance sport boats such as drag racing boats, ski boats and competitive bass boats having outboard propeller drives are often equipped with a device that is characterized variously as an anti-cavitation plate, a hyrofoil, a planing foil or a stem lifting plate. Although different functions are implied by each of these descriptive characterizations, each represents a certain measure of descriptive accuracy.

Generally, an anti-cavitation plate is a relatively thin, fin-like element that radiates in a horizontal plane from the propeller drive shaft housing in close proximity above the propeller arc. If the plate structure is present by design of the propulsion apparatus manufacturer, the plate device is usually an integrally cast component of the drive shaft housing. If applied to the propulsion apparatus as an auxiliary or accessory device, the plate structure may be externally secured to the housing by welding or by brackets that are attached by threaded fasteners.

At low boat speeds when the boat propeller and a cooperative anti-cavitation plate are completely submerged, water flowing against the plate is deflected downward by the plate bottom surface into the propeller to increase the hydrodynamic pressure around the propeller. Such increased fluid pressure around the propeller retards the onset of propeller blade cavitation. Blade cavitation is a hydrodynamic condition whereat a propeller blade is moving at a velocity greater than the surrounding fluid medium can flow into the space displaced by the blade. Hence, the propeller blade path leaves a vacuum behind the blade which retards the blade advance and increases the magnitude of power required to maintain the blade speed. Since the plate device above the propeller tends to increase the speed at which cavitation begins, the "anti-cavitation" description is valid.

From a different perspective, the fluid ram forces that generate greater fluid pressure below the plate also generate lift and upward force on the plate structure. Since the plate structure is secured to the drive shaft housing and, ultimately to the boat transom, this lifting force on the plate effectively lifts the boat stem to a more shallow depth of penetration below the water surface.

Competitive speed boats, for example, take advantage of the anti-cavitation and lifting synergism with foil plates such as those known in the art as Whaletail® or StingRay®. Proprietary foil plates such as these increase the plate area to improve the boat "hole-shot" performance, i.e., the elapsed time from a dead-stop in the water to top-surface planing. As an average, a good hole-shot time is about 5 seconds. Hence, it is also valid to characterize the device as a "stem lifting plate".

Boats of the type and capacity to which the present invention pertains have speed capabilities considerably in excess of 60 mph. Although a stem lifting plate is useful for quickly achieving that speed, the utility ends when the plate rises above the water surface. At 80 m.p.h. and above, half or less of the propeller circle engages the water surface and a stem lifting plate is entirely above the water surface. The boat is supported at the stem end on a small area of the keel/bottom area. The boat bow is supported by aerodynamic ground effect. When a boat is running in this configuration, a prior art anti-cavitation plate or stem lifting plate becomes the source of speed retarding drag.

Above 80 m.p.h., about half or more of the propeller circle is above the water surface. As a propeller blade turns forcefully from the gaseous atmosphere of the air above the water surface into the liquid surface, the impact produces a forward and upwardly directed spray from the water surface. Similarly, as a propeller blade rises from the liquid body, water attached to the blade surface is propelled centrifugally into the atmosphere above the water.

In sum, a stem lifting plate that provides a substantial planform area above a propeller blade may greatly improve the boat hole-shot with a rapid rise of the unit out of the water and onto the planing step. However, once on the planing "step", this same structure above the water surface tends to reduce the boat top or maximum speed. Therefore, to gain one or two seconds from the hole-shot, a competitor may sacrifice ten or more seconds in his overall time due to high speed parasitic forces on the lifting plate. Descriptively, the prior art lifting plate receives and deflects the propeller spray back against the propeller into the water surface proceeding the propeller. Water that is hurled from the propeller blade by centrifugal force strikes a prior art stem lifting plate in a spray of droplets. This highly energized spray strikes the prior art foil in an area aft of the propeller plane. However, the longitudinal pitch axis of the boat under this operating condition is forward of the propeller plane. Consequently, the impulse force of the propeller spray striking the prior art lifting plate behind the propeller plane induces a force couple that presses the boat bow downward against the aerodynamic lift and into the water surface. Due to increased water surface contact by the boat bow, drag forces on the boat are increased thereby reducing the boat speed. Furthermore, because the propeller spray is deflected by the prior art foil back into the spray jet from the propeller, reactive thrust from the propeller is reduced by the jet disturbance.

It is an object of the present invention to provide a hydro-planing foil that does not sacrifice the top speed capacity of a boat for a short-term hole-shot acceleration period.

A further object of the present invention, therefore, is to provide a hydro-planing foil having minimal surface area within the propeller plane to interrupt the spray of water from the propeller.

Another object of the invention is a hydroplaning foil having a trailing edge that is advanced from the propeller rotational plane.

Also, an object of the invention is a hydroplaning foil having down turned lateral tips to augment lift of the vessel out of the water when starting and to controllably shed propeller water spray away from the propeller arc.

SUMMARY OF THE INVENTION

These and other objects of the invention are met by a detachable hydro-planing foil having a relatively thin cross-sectional thickness. Lateral edges of the foil extend symmetrically about six to ten inches in opposite directions from a centerline. These opposite lateral edges of the foil are turned to a negative dihedral angle of about 25° to about 45°. Additionally, these negative angle tips are turned about a line parallel with the propeller thrust line and about 1 to 1.5 in. inward from the lateral extremes of the tip.

The hydro-planing foil leading edge is preferably back-swept symmetrically from the foil centerline at about 40° to about 50°. The trailing edges of the foil are forwardly arced from tangency with adjacent surface elements of the drive shaft housing. The sweep of the trailing edge arc positions the trailing edge forward of the boat propeller rotational plane.

The present hydro-planing foil may be secured by bolts, for example, to an anti-cavitation plate integrally with a combined drive housing as is provided by the power system manufacturer. In the absence of an OEM anti-cavitation plate, the present hydro-planing foil may be secured by means of a bracket that is welded or bolted to the drive housing.

BRIEF DESCRIPTION OF THE DRAWINGS

The following detailed description of the preferred embodiments of the invention is related to the drawings wherein.

DESCRIPTION OF THE PREFERRED EMBODIMENTS

Figure 1:
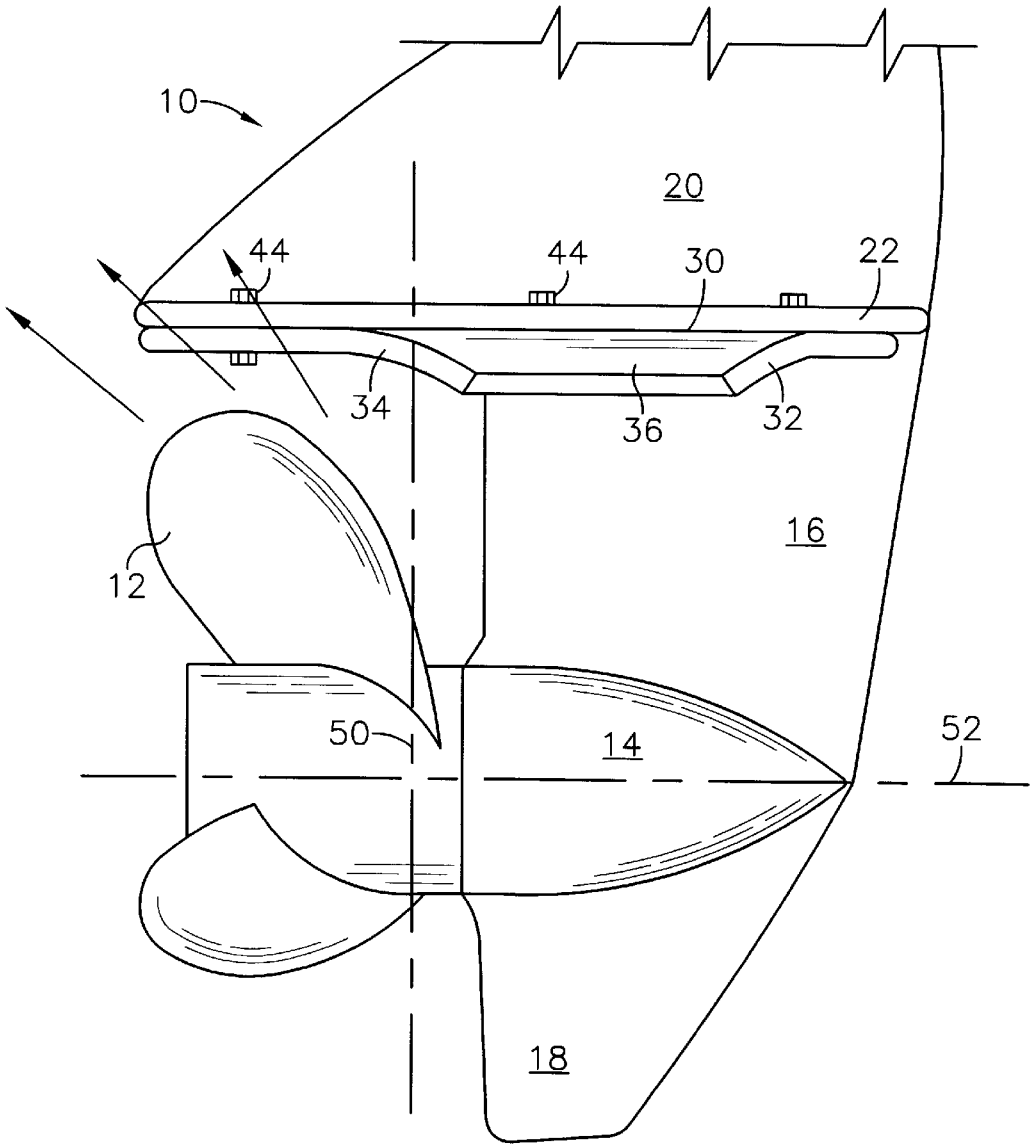
FIG. 1 is a partial side elevation of an outboard marine propeller drive.
Figure 2:
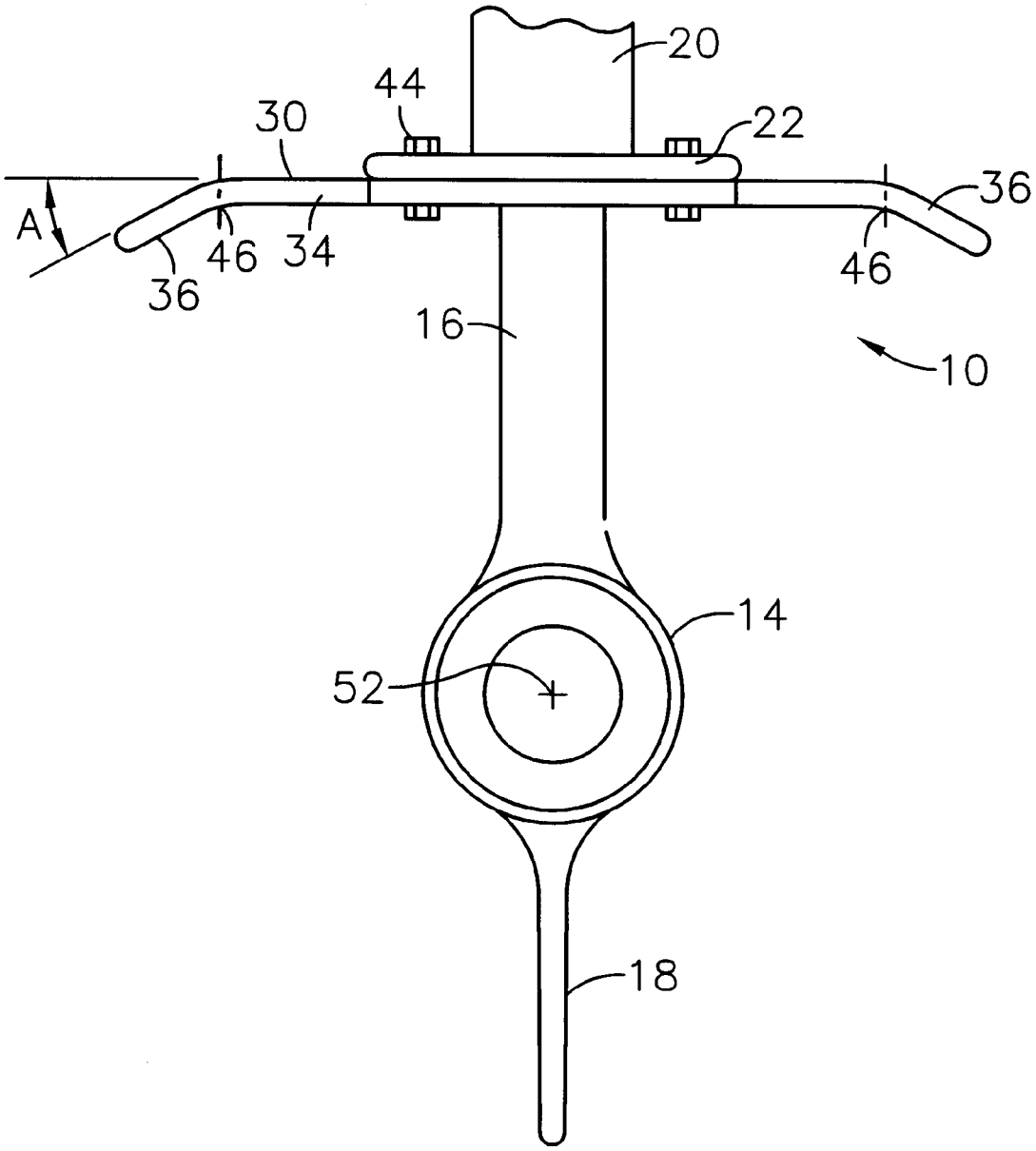
FIG. 2 is a partial end elevation of an outboard marine propeller drive.
Figure 3:
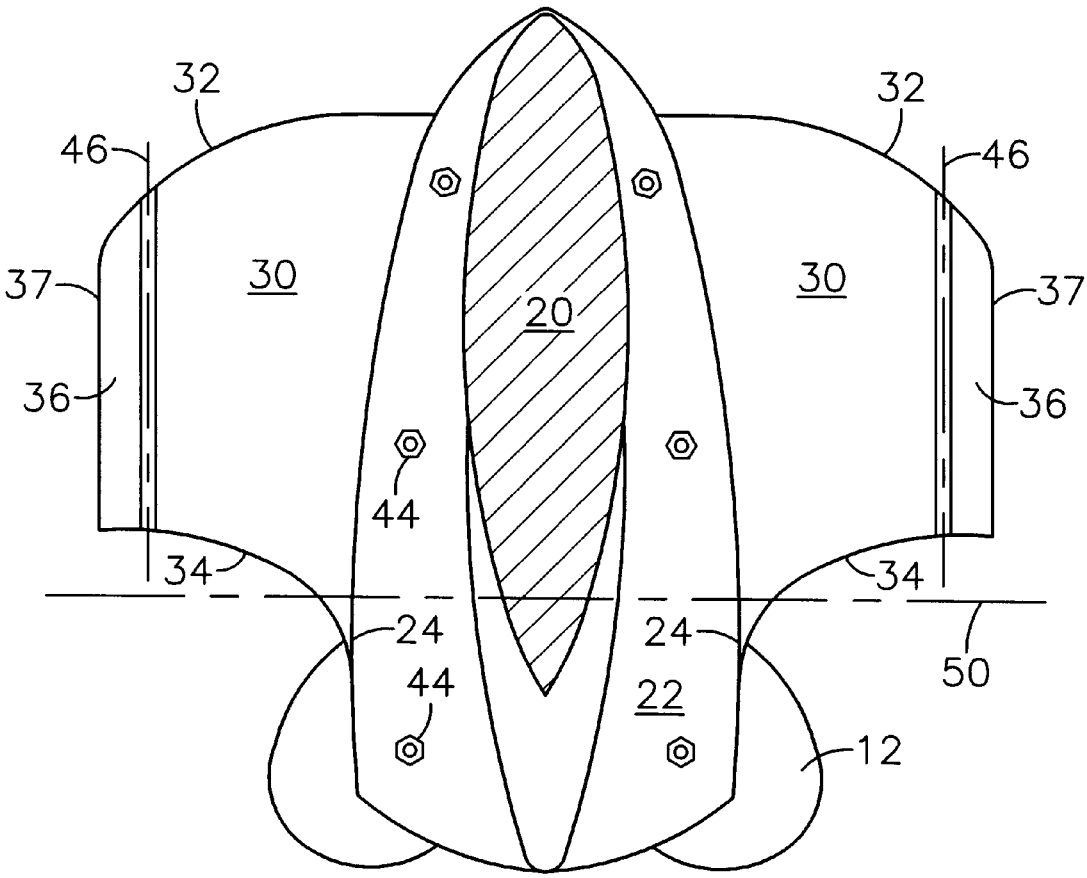
FIG. 3 is a top plan view of an outboard marine propeller drive.

Referring to the drawings wherein like reference characters designate like or similar elements throughout the several figures of the drawings, FIGS. 1, 2 and 3 illustrate an outboard propulsion assembly 10 that is particularly suitable for stern drive boats of about twenty-five feet in length or less. The basic elements of such an assembly comprise a propeller 12, lower gear case 14, a lower drive shaft housing 16 and a skeg 18. An upper drive shaft housing 20 is frequently combined by the original equipment manufacturer (OEM) with a relatively narrow plate structure 22 characterized as an anti-cavitation plate.

The hydro-planing foil 30 of the present invention is designed for attachment to an OEM plate 22 by means of bolts 44, screws or other suitable fasteners that penetrate fastener apertures 40. It will be understood to those of ordinary skill in the art that the hydro-planing foil 30 may also be secured to the drive shaft housing without benefit of the OEM plate 22 by means of side brackets or flanges not illustrated that are secured to the drive shaft housing by welding or machine screws turned into the drive shaft housing wall.

Figure 4:
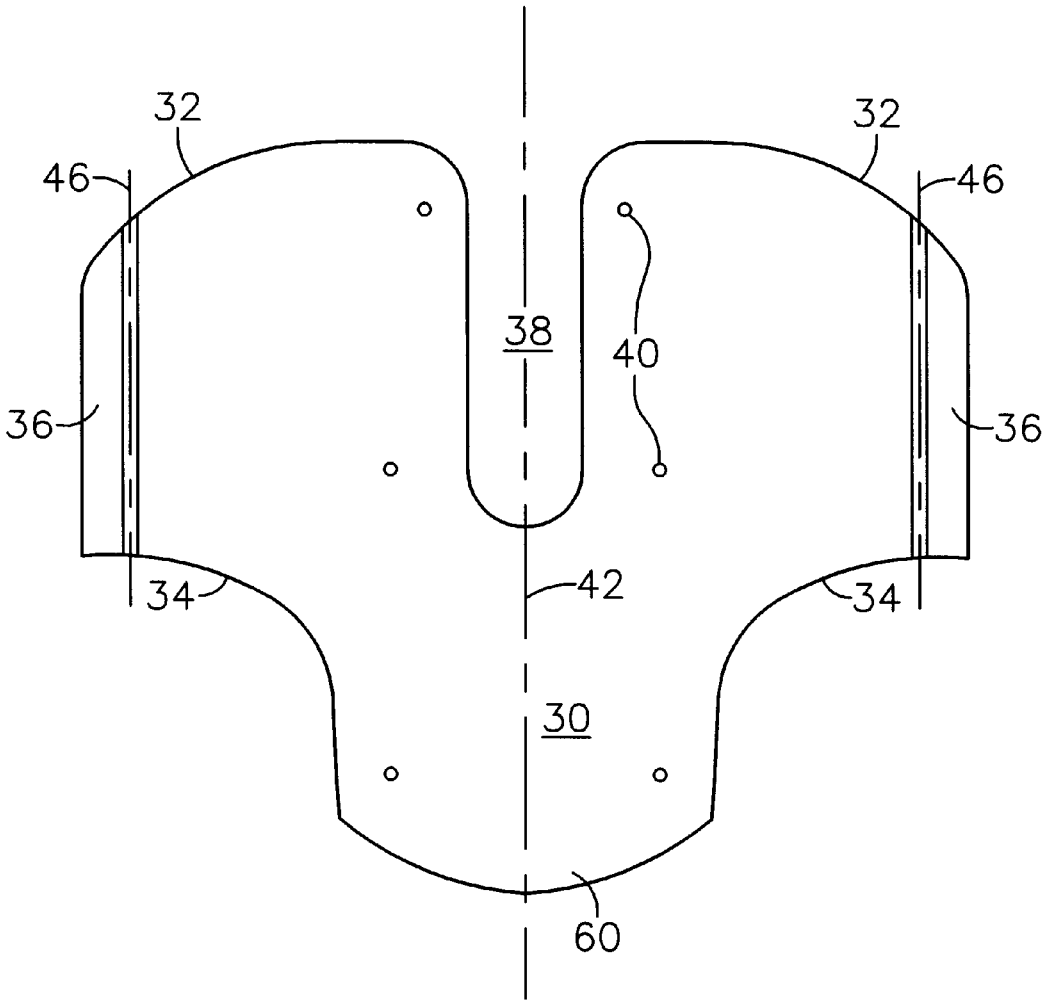
FIG. 4 is a top plan view of the hydro-planing foil invention.

With respect to FIG. 4, the hydro-planing foil 30 is laterally symmetric with respect to the foil centerline 42. In the normal configuration, the foil 30 centerline 42 is in substantially co-planar alignment with the propeller thrust axis 52.

The tail 60 of the hydro-planing foil 30 is substantially configured to the profile of the OEM plate 22. As the lateral or side edges 24 of the OEM plate 22 sweep forwardly to convergence, the laterally symmetric trailing edges 34 of the hydro-planing foil 30 arc forwardly to smoothly transition the foil 30 planform forward of the propeller rotational plane 50 out to the opposite hydrofoil tips 36. The foil tips 36 are about six to ten inches from the foil center-line 42 and terminate with elongated edges 37. Additionally, the hydrofoil tips 36 are preferably turned downwardly with a negative dihedral angle about bending axes 46 which are substantially parallel with the propeller thrust axis 52. These bending axes 46 are about 1 in. to about 1.5 in. inward from the respective edges 37.

Preferably, the negative dihedral angle A shown by FIG. 2 is about 30° and within the range of about 25° to about 45°. An angle of less than about 25° provides little if any contribution to the boat lifting function. Conversely, an angle of greater than about 45° generates excessive drag at the upper speed range of the boat due to deflected bottom spray.

The leading edges 32 of the plate 30 are preferably backswept at about 45°. The housing notch 38 permits the plate 30 to mesh about the engine drive shaft housing 16 to the depth required that will position the trailing edges 34 forward of the propeller rotational plane 50.

For applications having no OEM plate 22, it may not be necessary to sweep the hydrofoil trailing edges 34 to avoid the propeller rotational plane. Straight or linearly swept foil trailing edges may be preferred. Without an OEM plate for secure attachment of the present hydro-planing foil to the drive shaft housing, it would be appropriate to secure mounting brackets to the drive shaft housing by welding or threaded fasteners.

Consider also, that the aft flange plate portion of an OEM plate 22 may be removed from the drive shaft housing, thereby permitting the trailing edge of the present hydrofoil to be extended linearly.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally and equitably entitled.

I claim:

1. A marine propulsion assembly having a propeller driven about a rotational axis by drive means confined within a housing, a zone of propeller rotation emanating radially from said axis and a non-pivoting hydro-planing foil rigidly attached to said housing in a plane substantially parallel with said axis and above said propeller, said hydro-planing foil having leading edges, trailing edges and lateral tips, said trailing edges being substantially aligned in advance of said zone of propeller rotation so that water spray produced by the propeller during operation avoids contact with the hydro-planing foil.

2. A marine propulsion assembly as described by claim 1 wherein the lateral tips of said hydro-planing foil are turned to a negative dihedral angle.

3. A marine propulsion system as described by claim 2 wherein said negative dihedral angle is between about 25° to about 45°.

4. A marine propulsion assembly as described by claim 3 wherein said negative dihedral angle is about 30° or less.

5. A marine propulsion assembly as described by claim 3 wherein the lateral tips of said hydro-planing foil are turned about respective bending lines that are substantially parallel with said rotational axis.

6. A marine propulsion assembly as described by claim 1 wherein said leading edges are backswept.

7. A marine propulsion assembly as described by claim 1 wherein said trailing edges are arced in a forward concavity.

8. A hydro-planing foil for an outboard marine propulsion assembly having a propeller that is secured to a drive shaft housing for rotation about a thrust axis, said propeller being rotationally driven within a propeller plane, said hydro-planing foil comprising a substantially planar body having a leading edge, a trailing edge and lateral plate tips turned to a negative dihedral angle, and attachment means for rigidly securing said hydro-planing foil to said drive shaft housing above the propeller, said attachment means having alignment means for substantially locating said trailing edge in a plane that is forward of said propeller plane.

9. A hydro-planing foil as described by claim 8 wherein said negative dihedral angle is between about 25° and about 45°.

10. A hydro-planing foil as described by claim 9 wherein said negative dihedral angle is about 30° or less.

11. A hydro-planing foil as described by claim 8 wherein said lateral plate tips are turned to said negative dihedral angle about respective break lines that are substantially parallel with said rotational axis.

12. A hydro-planing foil as described by claim 8 wherein said leading edge is backswept substantially symmetrically from a center line.

13. A hydro-planing foil as described by claim 8 wherein said trailing edge is arced in a forward concavity substantially symmetrically from a centerline.

14. A marine propulsion assembly as described by claim 1 wherein said trailing edges are arced to form two concave portions.

15. A hydro-planing foil for a propulsion assembly of a marine craft, the propulsion assembly having a propeller secured to a drive shaft housing for being rotationally driven about a thrust axis within a propeller rotational plane, said hydro-planing foil comprising a substantially planar body rigidly attached to said drive shaft housing at a location above the propeller, said substantially planar body having a leading edge, a trailing edge, and lateral tips, said trailing edge being positioned substantially forward of the propeller rotational plane so that water spray produced by the propeller during operation of the marine craft avoids contact with the hydro-planing foil.

16. A hydro-planing foil as described by claim 15 wherein said hydro-planing foil is rigidly attached to said drive shaft housing by a fastener which fastens the hydro-planing foil to an anticavitation plate forming a portion of the drive shaft housing.

17. A hydro-planing foil as described by claim 15 wherein said trailing edge is arced to form at least one concave portion.

* * * * *